United States Patent [19]

Yoshihara

[11] Patent Number: 4,951,800

[45] Date of Patent: Aug. 28, 1990

[54] COIN VALIDATOR

[75] Inventor: Kenzo Yoshihara, Konosu, Japan

[73] Assignee: Kabushiki Kaisha Nippon Conlux, Tokyo, Japan

[21] Appl. No.: 354,048

[22] Filed: May 19, 1989

[30] Foreign Application Priority Data

Jun. 30, 1988 [JP] Japan ..... 63-163374

[51] Int. Cl.[5] ..... G07D 5/08

[52] U.S. Cl. ..... 194/317; 194/328

[58] Field of Search ..... 194/317, 318, 319, 328

[56] References Cited

U.S. PATENT DOCUMENTS

| | | | |
|---|---|---|---|
| 3,506,103 | 4/1970 | Kuckens et al. | 194/318 |
| 4,334,604 | 6/1982 | Davies | 194/319 |
| 4,846,332 | 7/1989 | Quinlan | 194/317 |

FOREIGN PATENT DOCUMENTS

| | | |
|---|---|---|
| 39-21291 | 9/1964 | Japan . |
| 52-69395 | 6/1977 | Japan . |
| 53-82397 | 7/1978 | Japan . |
| 56-123090 | 9/1981 | Japan . |
| 59-131104 | 7/1984 | Japan . |

*Primary Examiner*—F. J. Bartuska

*Attorney, Agent, or Firm*—Diller, Ramik & Wight

[57] ABSTRACT

A coin validator for discerning a thickness or a pattern of a coin in a non-contact manner. When the coin passes through a coin path, a coin sensor senses the passage of the coin to cause a change in a resonant frequency of a resonator and hence to fluctuate a resonant output voltage. The thickness and pattern of the coin are detected in accordance with that fluctuation. The resonator has a variable capacitance diode added thereto as a resonant element. If the resonant frequency of the resonator deviates out of a reference resonant frequency range, a voltage corresponding to the deviation is applied across the variable capacitance diode to provide feedback control such that the resonant frequency returns within the reference resonant frequency range.

15 Claims, 4 Drawing Sheets

COIN VALIDATOR

BACKGROUND OF THE INVENTION

1. Field of the Invention

This invention relates to coin validators used in various automatic service devices of vending machines, etc., and more particularly to such validators which discern the thickness and/or pattern of a coin in a non-contact manner.

2. Description of the Related Art

There is an electronic coin validator in which a pair of electrodes are disposed on the corresponding sides of a coin path to detect the difference between the capacitances on the electrodes on standby and during coin passage to thereby validate the coin.

More specifically, as shown in FIG. 5, the validator includes a pair of opposing electrodes 2 and 3 disposed so as to face the front and back of a coin 1 along a coin path, an oscillator 4 which outputs an oscillating signal of a predetermined frequency, a resonator 7 including a coil 5 and a capacitor 6 for applying its resonant output across the electrodes 2 and 3, a buffer 8 for amplifying the output signal from the resonator 7, a rectifying and smoothing circuit 9 for rectifying and smoothing the signal received via the buffer 8, an amplifier 10 for amplifying the output signal from the rectifying and smoothing circuit 9, and a thickness/pattern detector 11 for detecting the thickness and pattern of the coin 1 in accordance with a change in the rectified output signal via the amplifier 10 during the coin passage and reporting the result of the detection to a controller 12 for control of the components of the validator.

According to this arrangement, a series resonator of a resonant frequency $f_O = \frac{1}{2}\pi\sqrt{LC}$ is constituted by the oscillator 4 of an oscillating frequency $f_1$, coil 5 of L Henry and capacitor 6 of capacitance of C Farad, inclusive of the capacitance between the electrodes. The resonant characteristic of FIG. 6 is represented by a resonant curve shown by the solid line a on standby wherein a voltage $v_1$ is generated across the capacitor 6.

Under such condition, when a coin passes between the electrodes 2 and 3, the capacitance across the electrodes 2 and 3 changes and the total capacitance C changes, the resonant frequency changes from $f_0$ to $f_{oc}$ and the resonant characteristic changes to the curve represented by the broken line b as shown in FIG. 6. Then the voltage across the capacitor 6 is attenuated from $v_1$ to $v_{1c}$ at a frequency $f_1$, namely, the change $v_1 - v_{1c}$ is generated. The detector 11 uses this change to discern the thickness and pattern of the coin.

If in the conventional validator the inductance of the coil 5 or the capacitance of the capacitor 6 changes, for example, due to a change in its ambient temperature or if components themselves vary from one manufacturing lot to another, the resonant frequency $f_0$ changes, for example, like $f_0'$ in FIG. 6 and the characteristic curve moves to the curve shown by the dot dashed line c, and thus the output voltage $v_1$ from the capacitor 6 on standby is attenuated to $v_1'$. Thus the difference between the output $v_{1c}$ obtained during the coin 1 passage and the voltage $v_1'$ is reduced to thereby lose the stability of the validation undesirably.

It is an object of the present invention to provide a coin validator which is capable of discerning the thickness or pattern of a coin in a stabilized manner.

SUMMARY OF THE INVENTION

According to the present invention, there is provided a coin validator comprising a coin sensor for sensing a coin passing through a coin path; an oscillator for outputting an oscillating signal of a predetermined frequency; a resonator resonant with the oscillating signal from the oscillator for applying a resonant output to the coin sensor; a detector for detecting the nature of the coin in accordance with the output signal from the resonator during coin passage; a variable capacitance diode added as a resonant element to the resonator; and a resonant frequency control circuit for restricting to within a predetermined range a change in the output signal from the resonator during coin non-passage by changing a voltage applied across the variable capacitance diode.

The present invention is characterized by the variable capacitance diode added as the resonant component to the resonator and the resonant frequency control circuit to vary the voltage applied across the diode to thereby suppress within a predetermined range a fluctuation of the output signal from the resonator during the time when no coin passes.

When the coin passes through the path, the coin sensor senses it and the resonant frequency in the resonator changes. This causes the resonant output voltage to change, which follows a change in the thickness or pattern of the coin. The thickness and pattern of the coin are detected with the voltage corresponding to the change or the waveform. If the magnitude of the change in the resonant output voltage signal is within a predetermined range of voltages, the coin is validated to be in the predetermined range of thicknesses. If the waveform of the resonant output voltage signal crosses a predetermined voltage level by a predetermined number of times, the thickness of the coin is considered to fluctuate in a given thickness range and is determined to "have a pattern".

If the resonant frequency obtained on standby deviates out of the reference resonant frequency range, for example, due to a change in the ambient temperature, a voltage corresponding to the deviation is applied across the variable capacitance diode, and feedback control is provided such that the resonant frequency falls within the reference resonant frequency range.

As just described above, according to the present invention, unstableness of or fluctuations in the resonant frequency due to a change in the ambient temperature, etc. is eliminated to thereby allow the thickness or pattern of the coin to be discerned in a stabilized manner.

DESCRIPTION OF THE PREFERRED EMBODIMENT

Figure 1:
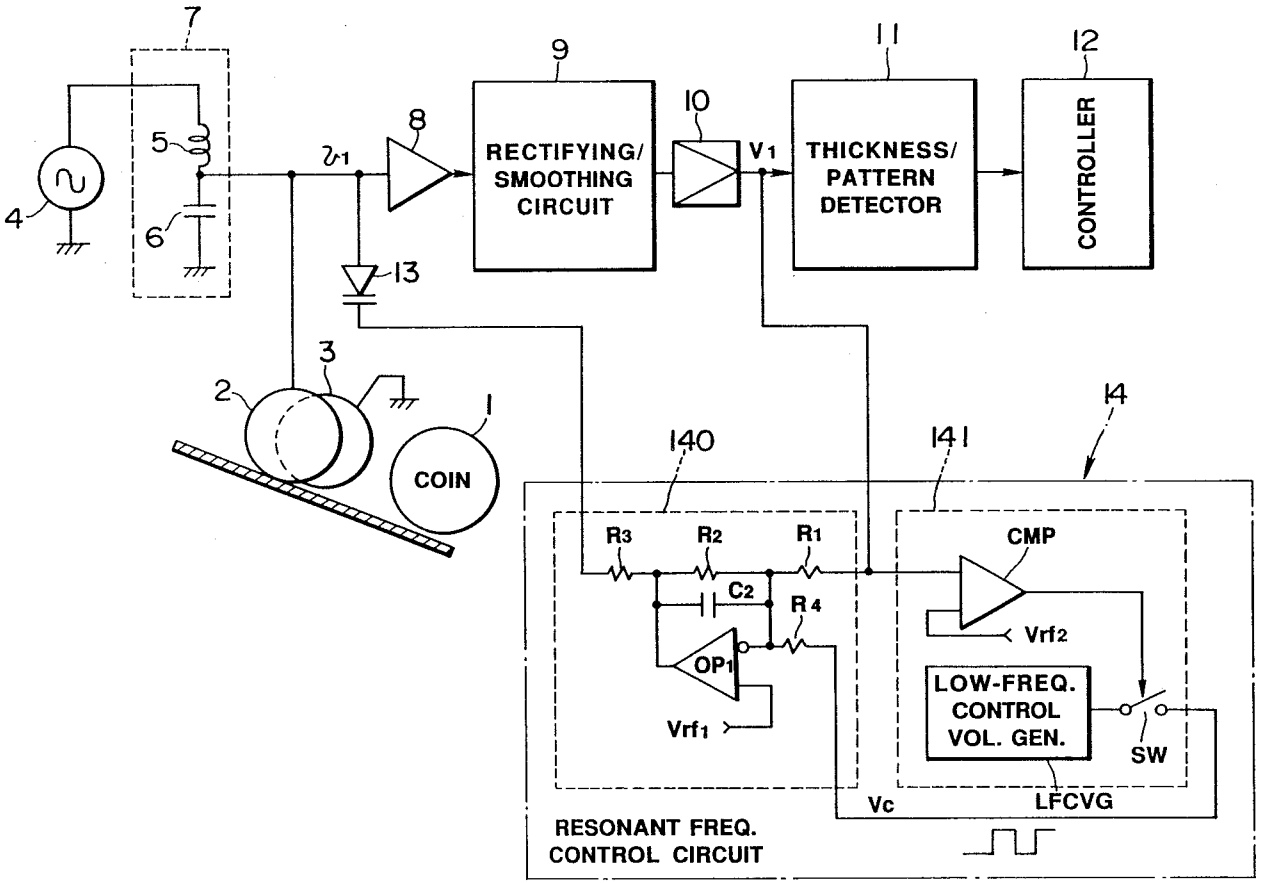
FIG. 1 is a circuit diagram of an embodiment of the present invention.

FIG. 1 is a circuit diagram of one embodiment of a coin validator according to the present invention. Like parts or elements are identified by like reference numerals in FIGS. 1 and 5 where FIG. 5 shows a prior validator, and further description thereof will be omitted.

Figure 5:
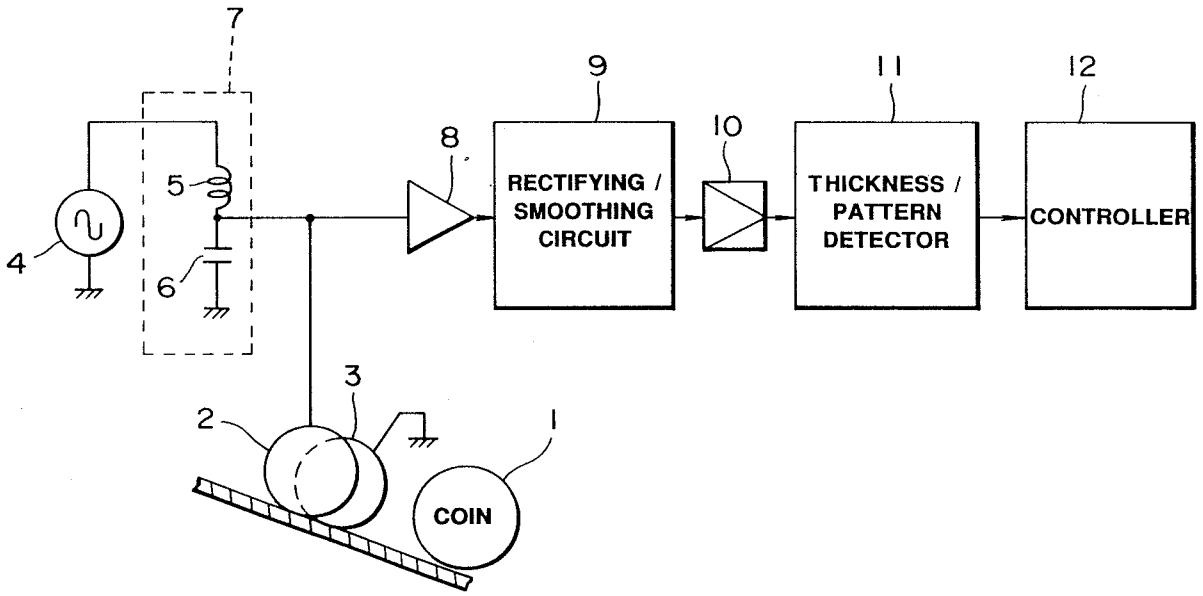
FIG. 5 is a circuit diagram of a conventional coin validator.

In FIG. 1, a variable capacitance diode 13 is newly added as one of the resonator components of a resonator 7 compared to the validator of FIG. 5. A controller 14 which restricts fluctuations of the resonant frequency in the resonator 7 to within a predetermined range by applying a voltage across the diode 13 is newly added as well.

The controller 14 includes a first control unit 140 which finely adjusts fluctuations of the resonant frequency in a predetermined control region, and a second control unit 141 which returns the resonant characteristic into the control region when the resonant frequency departs out of the control region of the first control unit 140.

The first control unit 140 includes an operational amplifier $OP_1$, an integrating capacitor $C_2$, and resistors $R_1$ -$R_4$ with a reference voltage $V_{rf1}$ applied to one input terminal of the amplifier $OP_1$. An output voltage $v_1$ is applied from the amplifier 10 via the resistor $R_1$ to the other input terminal of the amplifier $OP_1$ to which the control voltage $V_c$ is also applied from the second control unit 141 via the resistor $R_4$. The output from the operational amplifier $OP_1$ is applied across the diode 13 via the resistor $R_3$.

The second control unit 141 includes a comparator CMP which compares the reference voltage $V_{rf2}$ with the output voltage $v_1$ from the amplifier 10 and turns on a switch SW when the $v_1 < V_{rf2}$, and a low-frequency control voltage generator LFCVG which provides a control voltage $V_c$ changing at a low frequency between the high and low levels via the switch SW and to the input resistor $R_4$ of the operational amplifier $OP_1$ of the first control unit 140.

In the above arrangement, the process for validating a coin is similar to that performed by the prior validator and further description thereof will be omitted. Only the control of the resonant frequency will be described in detail below.

Figure 2:
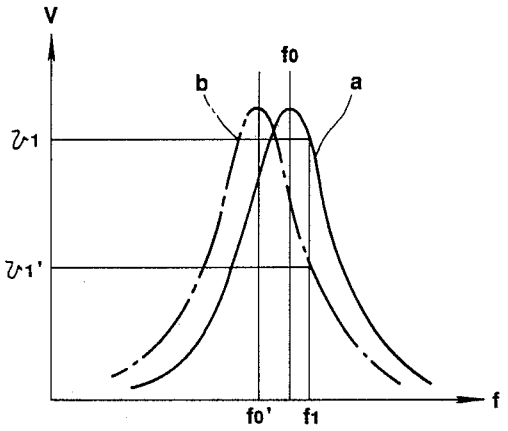
FIG. 2 is a characteristic diagram indicative of a change in the resonant frequency.

First, in FIG. 1, the oscillator 4 generates an oscillating signal of a frequency $f_1$. The resonant frequency $f_0$ of the resonator 7 is given by $$f_0 = 1/2\pi \sqrt{L(C + C_D)}$$

where L is the inductance of the coil 5 (Henry), $C_D$ is the capacitance of the diode 13, C is the total of the stray capacitance inherent to the electrodes 2 and 3 and the capacitance of the capacitor 6 (Farads). The relationship between $f_0$ and $f_1$ is $f_0 < f_1$, as shown in FIG. 2. Reference character $v_1$ in FIG. 2 denotes a voltage across the capacitor 6 at $f_1$ of the resonant curve a represented by the solid line.

For instance if the inductance value L or capacitance value C changes, the resonant frequency $f_0$ fluctuates, and the resonant curve a represented by the solid line in FIG. 2 moves leftward (toward a lower frequency) or rightward (toward a higher frequency). Namely, if L, C or $C_D$ increases, the resonant curve a moves leftward in FIG. 2 while if L or $C_D$ decreases, the resonant curve a moves rightward.

Assuming that the inductance of the coil 5 increases to L', the resonant frequency changes from $$f_0 = 1/2\pi \sqrt{L(C + C_D)}$$

to $$f_0' = 1/2\pi \sqrt{L'(C + C_D)}$$

and the resonant curve moves from the curve a (solid line) to the curve b (dot-dashed line). As a result, the voltage across the capacitor 6 is attenuated from $v_1$ to $v_1'$ in FIG. 2.

It is meant by this fact that the output direct current voltage from the amplifier 10 is attenuated from $V_1$ to $V_1'$ via the buffer 8 and the rectifying and smoothing circuit 9.

Figure 3:
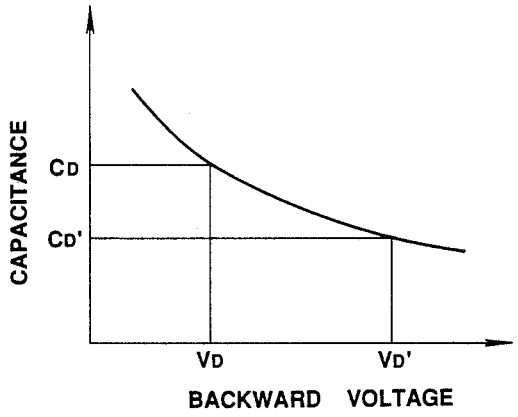
FIG. 3 is a general characteristic diagram of a variable capacitance diode.

The voltage $V_1'$ is compared with $V_{rf1}$ by the first control circuit 140, and a voltage proportional to the difference between $V_1'$ and $V_{rf1}$ (the ratio of $R2/R_1$) is output by the first control circuit 140 and applied to the cathode of the variable capacitance diode 13, the general characteristic of which is that if the backward bias applied across the diode is high, its capacitance is small as shown in FIG. 3 where the axis of abscissas represents the backward bias applied across the diode and the axis of ordinates the capacitance of the diode. Assuming that the voltage across the diode 13 increases from $V_D$ to $V_D'$ by the operation of the first control circuit 140, the diode capacitance decreases from $C_D$ to $C_D'$. Thus, the resonant frequency changes from $f_0'$ to $$f_0'' = 1/2\pi \sqrt{L'(C + C_D')}$$

which means approach to the resonant frequency approaches $f_0$.

This also means that by the feedback operation via the first control circuit 140, finally the resonant frequency converges to $f_0$ even if the inductance L increases.

While the above concerns the explanation of the validator operation caused by an increase in the inductance value L, a similar operation will be performed if the inductance value L decreases or the capacitance fluctuates. As a result, the thickness and pattern of the coin can be detected in a stabilized manner in the detector 11.

Since a transient fluctuation of $v_1$ during coin passage appears as a fluctuation in the output of the amplified 10, the feedback control at this time, if any, is undesirable. In order to avoid such undesirable operation, such fluctuation is absorbed by delaying the response of the amplifier using the integrating capacitor $C_2$ to thereby avoid a fluctuation of the voltage applied across the variable capacitor diode 13.

Figure 4:
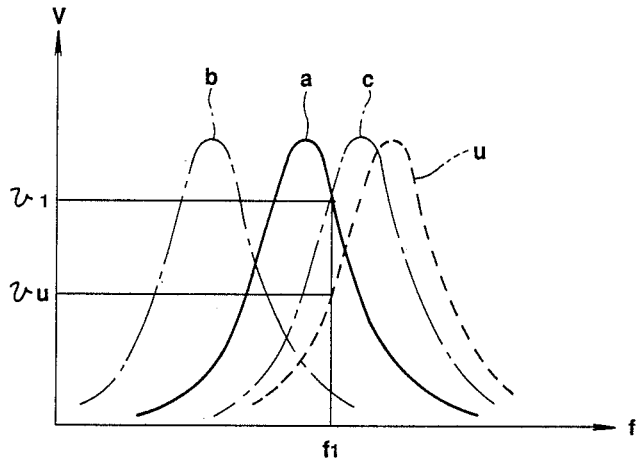
FIG. 4 is a characteristic diagram illustrating the feedback control of the resonant frequency.
Figure 6:
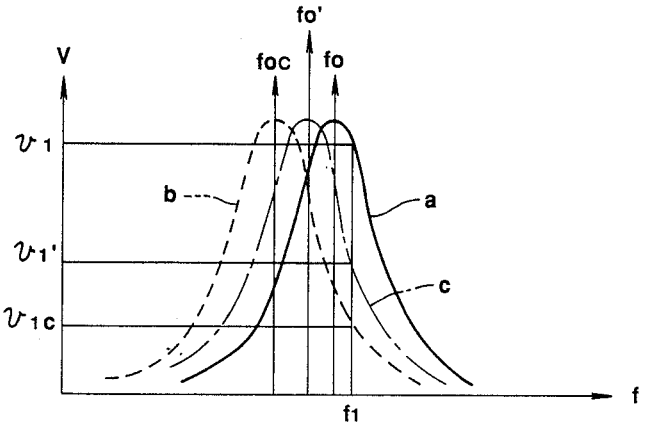
FIG. 6 is a characteristic diagram illustrating a change in the resonant frequency in the conventional validator.

The region for the feedback control of the resonant frequency by the first control circuit 140 is set between the dot-dashed curves b and c of FIG. 4 where the curve b indicates that the output of the operational amplified $OP_1$ is close to the plus saturated state and in a lower or an upper limit of the region where feedback control is possible.

Assume under such condition that the inductance value L of the coil 5 or the capacitance value C of the capacitor 6 increases and the resonant curve moves leftward from b. In order to move back the moved curve rightward, it is necessary to increase the backward bias across the diode 13. To this end, the output voltage from the operational amplifier $OP_1$ of the first control circuit 140 must be increased. However, since the output voltage of the operational amplifier $OP_1$ is close to the plus saturated state, it cannot be increased any longer, and thus feedback control is impossible.

If the characteristic curve moves from the curve c to the right-hand curve u, the voltage across the capacitor 6 becomes $v_u$ in FIG. 4, and as a result of a comparison with the reference voltage $V_{rf1}$, the output of the first control circuit 140 becomes high. This causes the capacitance of the diode 13 to reduce. The curve u moves rightward away from the actual curve a, so that feedback control is impossible. The second control circuit 141 serves to compulsively return to within the control area of the first control circuit the curve which has moved to the left-hand side of the curve b or the curve u which has moved to the right-hand side of the curve c. Namely, if the backward bias $V_D$ applied across the diode 13 is reduced compulsively, $C_D$ increases, the curve u moves once leftward to enter between the curves b and c. After this, feedback is possible and the characteristic is settled at the curve a (solid line).

The comparator CMP of the second control circuit 141 determines that the operation is outside the feedback enable state if the output voltage from the operational amplifier 10 is low compared to the reference voltage $V_{rf2}$, and turns on the switch SW. Thus, the output voltage $V_c$ (at high level) from the low-frequency control voltage generator LFCVG is applied to the input of the operational amplifier $OP_1$ of the first control circuit 140 via the switch SW.

Then, the output voltage of the amplifier $OP_1$ decreases, and as a result, the backward bias $V_D$ of the diode 13 decreases while the capacitance value $C_D$ increases. Thus, the resonant curve u moves close to the curve b. Under such condition, if the control voltage $V_c$ changes from high to low, the output voltage from the amplifier $OP_1$ is switched so as to increase. Thus, the capacitance $C_D$ of the diode 13 decreases, the curve u which is in the vincinity of the curve b moves toward the curve a. This causes the output voltage $v_1$ from the amplifier 10 to increase. If $v_1$ exceeds the reference voltage $V_{rf2}$, the switch SW is turned off by the output from the comparator CMP, and the curve u is settled in the same region as the curve a.

If the resonant curve deviates further to the left of the curve b, it will be moved back close to the curve a by a similar operation.

As just described above, according to the particular embodiment, the resonant frequency of the resonator 7 is settled close to $f_0$ by the resonant frequency control circuit 14 and fluctuations of the output signal from the resonator are feedback controlled so as to be within a predetermined range. Therefore, even if the capacitance of the capacitor 6, etc., fluctuates due to changes in the ambient conditions such as temperature, the coin can be validated in a stabilized manner.

While in the particular embodiment the resonant frequency control circuit 14 is composed of the first control unit 140 which finely adjusts fluctuations of the resonant frequency within the predetermined control region and the second control circuit 141 which moves back the resonant characteristic to within the control region when the resonant frequency deviates out of the control region of the first control circuit 140, the control circuit 14 may be composed of only the first control circuit by removing the second control circuit.

While in the embodiment the arrangement in which a change in the capacitance due to the depositing of a coin is detected has been illustrated, a coin may be validated using an fluctuation of the inductance of the coil disposed in the vicinity of the coin path. This fundamentally uses a voltage change produced due to the movement of the resonant curve of the resonator 7, and, to this end, the same circuit as that mentioned above may be usable.

The electrodes 2 and 3 and the coil 5 may be provided together in the vicinity of the coin path. If arrangement is such that the electrodes 2 and 3 and the coil 5 are positioned at appropriate distances from one another so as to avoid the mutual interference due to the passage of a coin, the coin can be detected electrostatically or magnetically by the same circuit.

While the resonator 7 is illustrated as being composed of a series resonator, it may be composed of a parallel resonator.

What is claimed is:

1. A coin validator comprising:

a coin sensor for sensing a coin passing through a coin path;

an oscillator for outputting an oscillating signal of a predetermined frequency;

a resonator resonant with the oscillating signal from the oscillator for applying a resonant output to the coin sensor;

a detector for detecting a nature of the coin in accordance with the output signal from the resonator during coin passage;

variable capacitance means added as a resonant element to the resonator; and a resonant frequency control circuit for restricting to within a predetermined range a change in the output signal from the resonator during coin non-passage by changing a capacitance of the variable capacitance means.

2. A coin validator according to claim 1, wherein the coin sensor includes a pair of electrodes disposed so as to face the front and the back of the coin for changing a resonant frequency from the resonator in accordance with a change in a static capacitance during the coin passage.

3. A coin validator according to claim 1, wherein the coin sensor includes a coil disposed in the vicinity of the coin path for causing a change in the resonant frequency of the resonator in accordance with a change in an inductance of the coil during the coin passage.

4. A coin validator according to claim 1, wherein the variable capacitance means includes a variable capacitance diode, and wherein the resonant frequency control circuit controls a voltage applied across the variable capacitance diode.

5. A coin validator according to claim 1, wherein the detector detects a thickness of the coin.

6. A coin validator according to claim 1, wherein the detector detects a pattern on the coin.

7. A coin validator according to claim 1, wherein the detector detects the thickness and the pattern of the coin.

8. A coin validator according to claim 1, wherein the resonant frequency control circuit includes a first circuit for restricting to within a predetermined control region a fluctuation of the resonant frequency of the resonator.

9. A coin validator according to claim 8, wherein the variable capacitance means includes a variable capacitance diode, and wherein the resonant frequency control circuit controls a voltage applied across the variable capacitance diode.

10. A coin validator according to claim 9, wherein the first circuit comprises:

an error signal forming circuit for forming an error signal indicative of a difference between the output from the resonator and a first reference voltage; and a circuit for applying the output from the error signal forming circuit across the variable capacitance diode.

11. A coin validator according to claim 1, wherein the resonant frequency control circuit comprises: a first circuit for restricting a fluctuation of the resonant frequency of the resonator to within a predetermined control region; and a second circuit for restricting the resonant frequency of the resonator to within the control region.

12. A coin validator according to claim 11, wherein the variable capacitance means includes a variable capacitance diode, and wherein the resonant frequency control circuit controls a voltage applied across the variable capacitance diode.

13. A coin validator according to claim 12, wherein the first circuit comprises:

an error signal forming circuit for forming an error signal indicative of a difference between the output from the resonator and a first reference voltage; and a circuit for applying the output from the error signal forming circuit across the variable capacitance diode.

14. A coin validator according to claim 13, wherein the second circuit comprises:

means for generating a low-frequency control voltage signal;

comparator means for comparing the output from the resonator and a second reference voltage to determine whether the output from the resonator is outside the control region; and switching means for superposing the output from the low-frequency control voltage signal generating means on the output from the resonator, which is applied to the error signal forming circuit, in accordance with the output from the comparator means indicative of a result of the comparison.

15. A coin valildator comprising:

a coin sensor for sensing a coin passing through a coin path;

an oscillator for outputting an oscillating signal of a predetermined frequency;

a resonator resonant with the oscillating signal from the oscillator for applying a resonant output to the coin sensor;

a circuit for rectifying and smoothing the output of the resonator;

a detector for detecting a nature of the coin in accordance with an output signal from the rectifying and smoothing circuit during coin passage;

a variable capacitance diode added as a resonant element to the resonator;

an error signal forming circuit for receiving the output of the rectifying and smoothing circuit and a first reference voltage to form an error signal indicative of a difference between the output of the rectifying and smoothing circuit and the first reference voltage;

a circuit for applying the output of the error signal forming circuit across the variable capacitance diode;

means for generating a low-frequency control voltage signal;

a comparator for comparing the output of the rectifying and smoothing circuit and a second reference voltage to determine whether the output of the rectifying and smoothing circuit deviates out of a predetermined control region; and switching means for superposing the output from the low-frequency control voltage signal generating means on the output from the rectifying and smoothing circuit, which is applied to the error signal forming circuit, in accordance with an output from the comparator indicative of a result of the comparison.

* * * * *